US008978530B2

(12) United States Patent
Jones et al.

(10) Patent No.: US 8,978,530 B2
(45) Date of Patent: Mar. 17, 2015

(54) CUTTING APPARATUS EMPLOYING A MAGNET

(75) Inventors: Robert E. Jones, College Place, WA (US); Robert B. Thompson, Milton-Freewater, OR (US)

(73) Assignee: Key Technology, Inc., Walla Walla, WA (US)

( * ) Notice: Subject to any disclaimer, the term of this patent is extended or adjusted under 35 U.S.C. 154(b) by 994 days.

(21) Appl. No.: 13/066,790

(22) Filed: Apr. 25, 2011

(65) Prior Publication Data

US 2012/0266730 A1 Oct. 25, 2012

(51) Int. Cl.

| | |
|---|---|
| ***B26D 7/08*** | (2006.01) |
| ***B26D 1/56*** | (2006.01) |
| ***B26D 5/08*** | (2006.01) |
| ***B26D 1/29*** | (2006.01) |
| ***B26D 1/11*** | (2006.01) |
| ***B26D 5/12*** | (2006.01) |
| ***B26D 7/00*** | (2006.01) |
| ***B26D 7/26*** | (2006.01) |
| ***B26D 1/42*** | (2006.01) |

(52) U.S. Cl.

CPC .. *B26D 1/29* (2013.01); *B26D 1/11* (2013.01); *B26D 5/12* (2013.01); *B26D 7/0006* (2013.01); *B26D 7/26* (2013.01); *B26D 1/42* (2013.01)

USPC ..... 83/169; 83/285; 83/563

(58) Field of Classification Search

CPC ..... Y10S 83/932; B26D 1/42

USPC ..... 83/169, 285–286, 290–291, 303, 314, 83/370, 372, 663, 674, 698.21

See application file for complete search history.

(56) References Cited

U.S. PATENT DOCUMENTS

| | | | | |
|---|---|---|---|---|
| 3,765,286 | A | 10/1973 | Vossen | |
| 4,520,702 | A * | 6/1985 | Davis et al. | 83/76.8 |
| 4,656,904 | A | 4/1987 | Rayment | |
| 5,029,504 | A * | 7/1991 | Wilbur et al. | 83/168 |
| 5,230,271 | A * | 7/1993 | Hardisty et al. | 83/698.21 |
| 5,235,880 | A * | 8/1993 | Wilbur et al. | 83/13 |
| 5,447,086 | A * | 9/1995 | Wittmaier et al. | 83/666 |
| 6,782,883 | B2 | 8/2004 | Chen et al. | |
| 7,051,632 | B2 * | 5/2006 | Hamilton et al. | 83/343 |
| 7,430,947 | B2 | 10/2008 | Julian et al. | |
| 7,748,303 | B2 | 7/2010 | Julian et al. | |
| 7,789,000 | B2 | 9/2010 | Julian et al. | |
| 7,849,771 | B2 | 12/2010 | Julian et al. | |
| 2004/0094006 | A1 * | 5/2004 | McGarvey et al. | 83/303 |
| 2005/0279228 | A1 | 12/2005 | Julian et al. | |

(Continued)

FOREIGN PATENT DOCUMENTS

CN 10161267 A * 12/2009

OTHER PUBLICATIONS

PCT Search Report Dated Feb. 1, 2013.

*Primary Examiner* — Sean Michalski
*Assistant Examiner* — Jonathan G Riley
(74) *Attorney, Agent, or Firm* — Paine Hamblen, LLP

(57) ABSTRACT

A cutting apparatus is disclosed and which includes a cutter knife which is reciprocally moveable along a path of travel, a track member mounted adjacent to the cutter knife, and which mechanically cooperates with the cutter knife so as to define, at least in part, a first non-cutting position, and the second, cutting position for the cutter knife, and a magnet mounted on the track member and which releasably magnetically restrains the cutter knife when the cutter knife is in either of the first non-cutting position, or the second, cutting position.

27 Claims, 9 Drawing Sheets

(56) References Cited

U.S. PATENT DOCUMENTS

2008/0302227 A1* 12/2008 Viljanen ..... 83/820
2009/0126549 A1* 5/2009 Dietz et al. ..... 83/817
2011/0079129 A1* 4/2011 Fuchs et al. ..... 83/698.21
2011/0179925 A1* 7/2011 Brown et al. ..... 83/471.3
2011/0296969 A1* 12/2011 Lenzotti ..... 83/563
2012/0325067 A1* 12/2012 Yamada et al. ..... 83/346

* cited by examiner

CUTTING APPARATUS EMPLOYING A MAGNET

TECHNICAL FIELD

The present invention relates to a cutting apparatus which is employed in connection with equipment for detecting defects in elongated articles and for cutting the defects from the articles as the articles are being processed in a high output production facility.

BACKGROUND OF THE INVENTION

The present invention as disclosed in the paragraphs which follow can be employed in connection with an inspection and cutting apparatus such as what is shown in U.S. Pat. No. 4,520,702. The content of this previous patent is incorporated herein by reference. U.S. Pat. No. 4,520,702 addressed a perceived problem then existing in the industry relative to the processing of elongated articles such as sliced potatoes utilized for frozen French fries, and wherein the elongated articles were first aligned in transversely spaced lanes and then passed beneath individual lane electro-optical cameras for inspecting the French fries for defects. In the previous prior art arrangements, if defects were encountered, one or more knives on a rotating wheel was projected or propelled from the wheel to cut the defect from the article. Various earlier U.S. Patents such as U.S. Pat. Nos. 3,543,035 and 3,664,337 describe such earlier devices. These prior art devices were deemed to be not very effective because it was very difficult to process large volumes of product utilizing the equipment illustrated in these previous prior art patents. U.S. Pat. No. 4,520,702 also describes various other prior art attempts to solve the perceived limitations on the processing of elongated articles that might have defects. The inventors in U.S. Pat. Nos. 4,520,702 and 6,923,028 for example, describe an invention which provides high volume inspection and cutting for removing defects from elongated articles with resulting equipment that is quite inexpensive and robust relative to its production capacity.

The device as shown in U.S. Pat. No. 4,520,702 for example, has been widely embraced by the food processing industry and has operated with a great degree of success through the years. While this apparatus as described in this prior art patent has operated quite reliably for several decades, there have been perceived shortcomings which have detracted from its usefulness. Chiefly, two perceived shortcomings have become evident through the continued use of the earlier mentioned apparatus. Firstly, and only occasionally, individual cutter knives employed in the apparatus as described in U.S. Pat. No. 4,520,702, when rotated at predetermined operational speeds occasionally will prematurely move or be ejected to a radially outwardly extended cutting position and engage the elongated food product being processed without first being deployed by the cutting apparatus. This premature deployment of a cutting knife to the radially extended cutting position could occasionally cause the cutting knife to become damaged. In addition to the foregoing, the cutting knives employed, to date, have been fabricated from a synthetic material, and due to normal wear and tear, and routine operating conditions, such prior art cutting blades occasionally break and need to be replaced. This type of wear related failure is expected, from time-to-time, in devices of this type, however, depending upon the product to be cut, and inspected, such replacement of cutting blades can sometimes be time consuming, and inconvenient during typical food processing plant operations.

Therefore, a principal object of the present invention is to provide an improvement to the inspection cutting apparatus as seen in U.S. Pat. No. 4,520,702 and which provides improved performance and other operational characteristics not possible, heretofore, in a device such as what has been described in this previous patent.

SUMMARY OF THE INVENTION

A first aspect of the present invention relates to a cutting apparatus which includes a cutter knife which is reciprocally moveable from a first non-cutting position, to a second, cutting position; a track member mounted adjacent to the cutter knife, and which mechanically cooperates with the cutter knife so as to define, at least in part, the first non-cutting position, and the second, cutting position of the cutter knife; and a magnet is mounted on the track member and which releasably magnetically restrains the cutter knife when the cutter knife is in the first non-cutting position, and the second, cutting position.

Another aspect of the present invention relates to a cutting apparatus which includes a cutter knife supported for reciprocal movement along a path of travel which has opposite ends; a source of fluid pressure selectively delivered to the cutter knife to move the cutter knife in a given direction along the path of travel from one end to the other; a track member positioned adjacent to, and mechanically cooperating with the cutter knife, and which is effective in defining the reciprocal movement of the cutter knife along the path of travel; and a magnet is mounted on the track member, and which is effective in magnetically attracting and partially restraining the cutter knife when the cutter knife is located at the opposite ends of the reciprocal path of travel.

Still another aspect of the present invention relates to a cutting apparatus which includes an axle; a circular knife support ring supported for rotation about the axle, and wherein the knife support ring has a peripheral edge, and further experiences centrifugal force when rotated; a plurality of cutter knives moveably supported by the knife support ring, and which are individually, radially, reciprocally moveable relative thereto; a source of fluid pressure selectively delivered to the respective cutter knives for selectively propelling the individual cutter knives along a path of travel which is radially, outwardly oriented relative to the knife support ring; an annular track member mounted on the axle, and located adjacent to the knife support ring, and wherein the annular track member has an outside peripheral edge, and further defines a plurality of tracks which mechanically cooperate with the plurality of cutter knives so as to cause the respective cutter knives to move radially inwardly, and outwardly, relative to the peripheral edge of the knife support ring, and along the path of travel, when the source of fluid pressure propels individual cutter knives radially outwardly relative to the knife support ring; and a magnet mounted adjacent to the peripheral edge of the of the annular track member, and which has a magnetic centripetal force which is effective so as to magnetically restrain the movement of the plurality of cutter knives in a radially outward direction relative to the knife support ring, and against the centrifugal force experienced by the knife support ring, and the respective cutter knives, when the knife support ring is rotated, and wherein the magnetic centripetal force acting on the respective cutter knives is overcome when the source of fluid pressure is applied to the respective cutter knives so as to move the respective cutter knives along the path of travel, and radially outwardly relative to the knife support ring.

These and other aspects of the present invention will be described in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
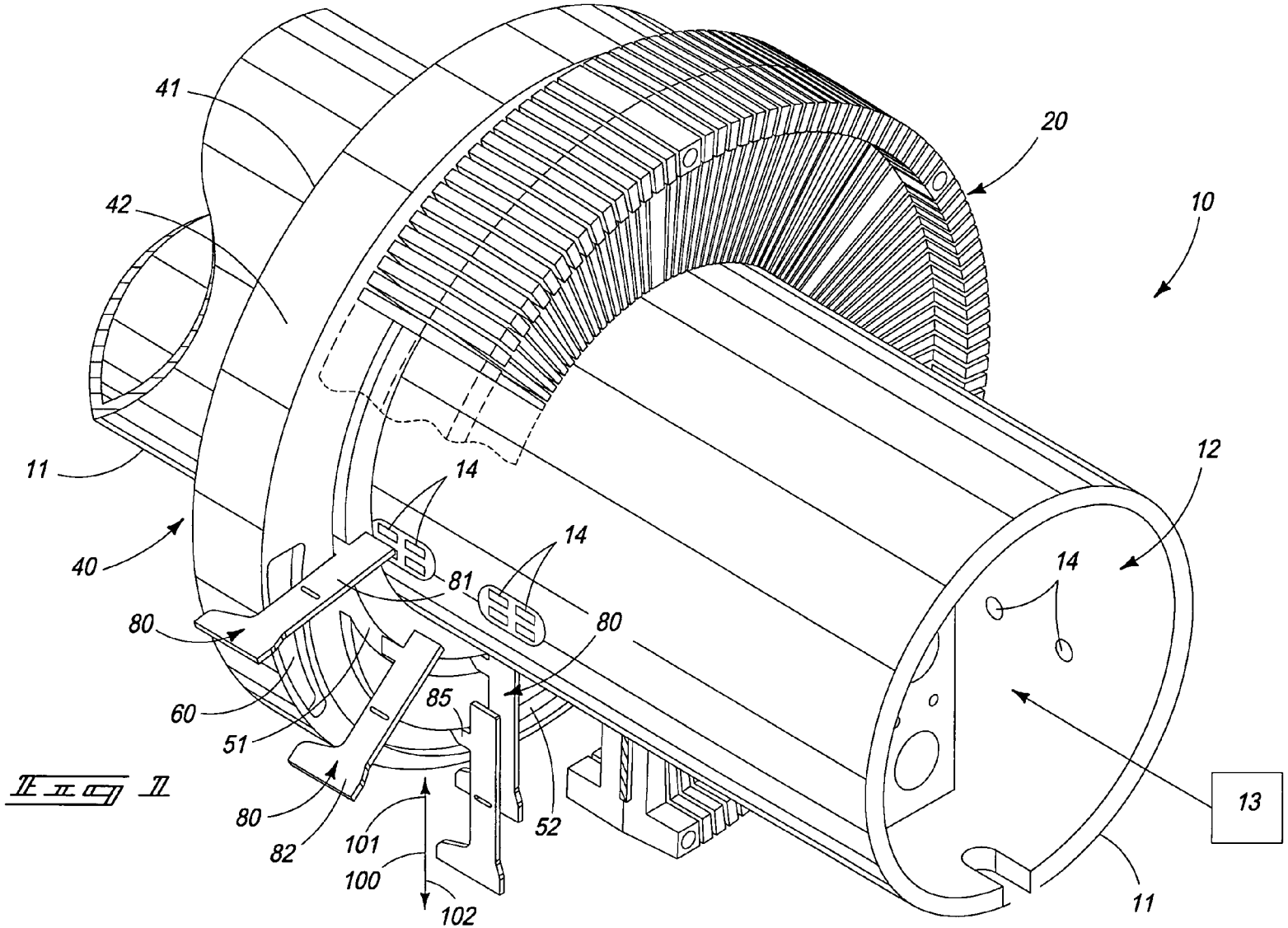
FIG. 1 shows a perspective, fragmentary view of an improved cutting apparatus of the present invention and showing the location of cutting knives in various orientations relative to the present cutting apparatus.

Referring now to a detailed study of FIG. 1, and following, it will be seen that the cutting apparatus 10 of the present invention includes a non-rotatable axle or support member which is generally indicated by the numeral 11. The non-rotatable axle defines an internal cavity 12 which encloses some structural features of the prior art cutting apparatus (U.S. Pat. No. 4,520,702) which are not directly germane to the present invention, but which are more fully disclosed in U.S. Pat. No. 4,520,702. Readers are referred to that patent to understand the structure of the axle employed in this invention, and illustrated in this drawing. In particular, the present invention 10 and more particularly the internal cavity 12 of the fixed axle 11 is supplied with a source of fluid pressure generally indicated by the numeral 13. This source of fluid pressure (typically compressed air) travels down the internal cavity, and is then selectively released by valve assemblies (not shown) through the apertures 14. This fluid pressure is applied to, or against the respective cutting knives so as to move them from a first non-cutting position to a second cutting position. The specifics of the movement of the respective cutting knives, and their structures, will be discussed in greater detail, hereinafter. Readers are referred to U.S. Pat. No. 4,520,702 for details regarding the valve assemblies employed to selectively release fluid pressure to the cutting knives that will be described hereinafter. As earlier noted, the substance of U.S. Pat. No. 4,520,702 is incorporated by reference into this application.

Figure 2:
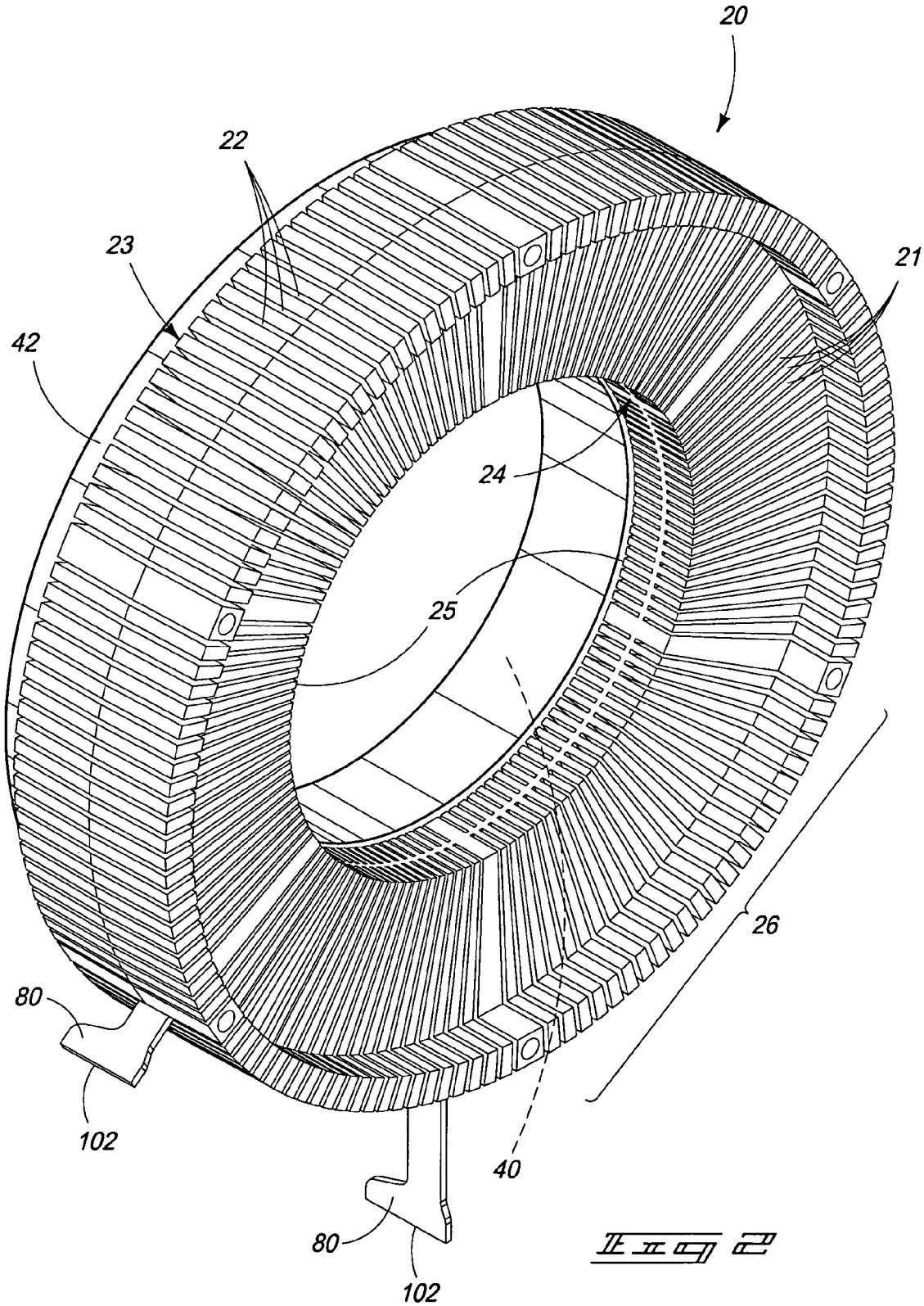
FIG. 2 is a perspective, side-elevation view of a knife support ring employed with the cutter apparatus of the present invention, and several cutting knives employed with the invention and which are positioned in various operational orientations.
Figure 3:
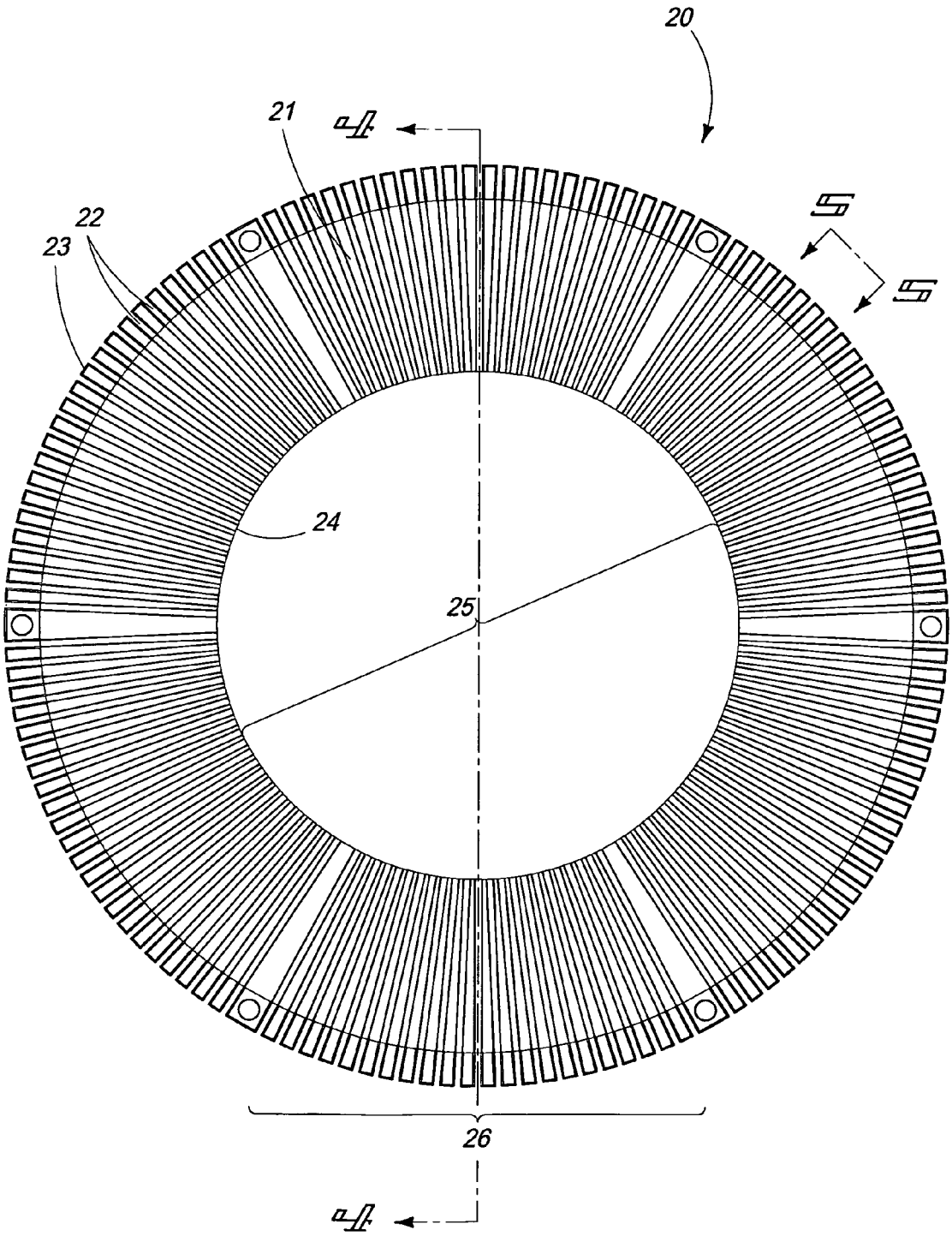
FIG. 3 is a side elevation view of the circular knife support ring as seen in FIG. 2.
Figure 4:
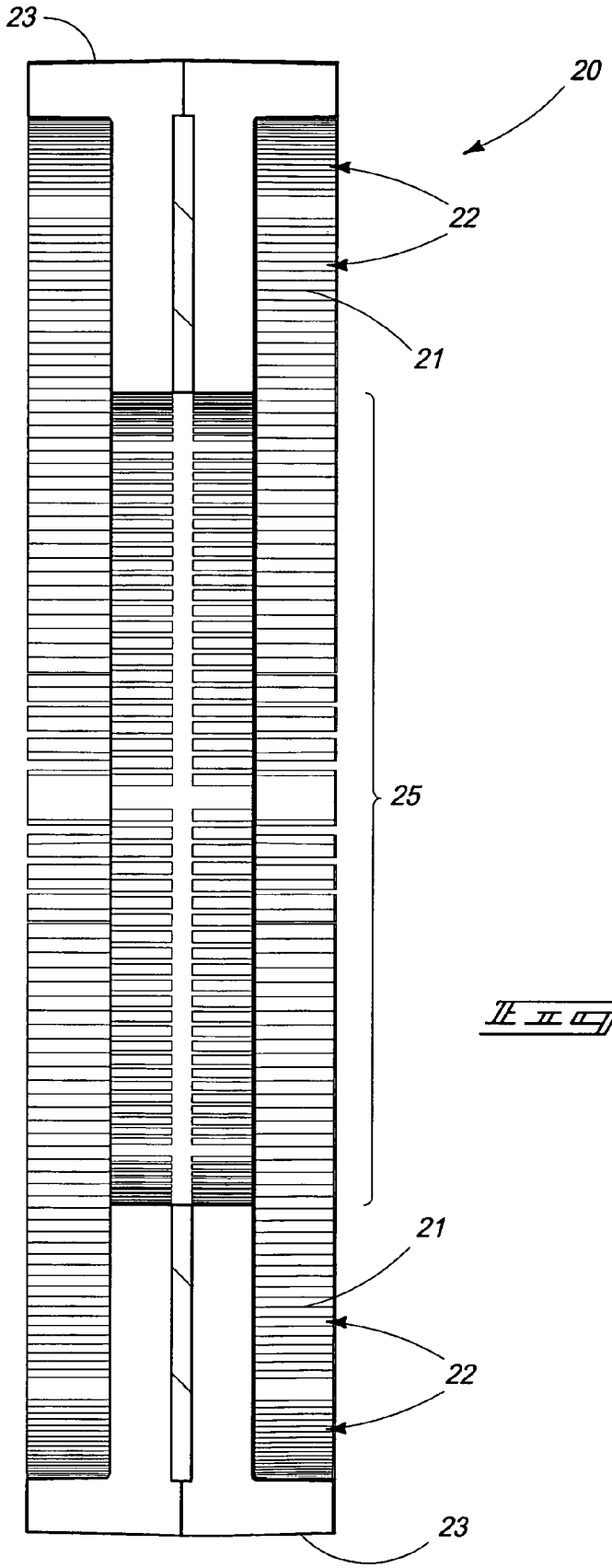
FIG. 4 is a transverse, vertical sectional view which is taken from a position along line 4-4 of FIG. 3.
Figure 5:
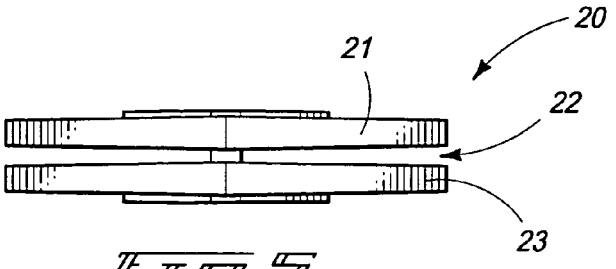
FIG. 5 is a partial, side-elevational view which is taken from a position along line 5-5 of FIG. 3.

A circular knife support ring 20 which is similar in structure to that described in U.S. Pat. No. 4,520,702 is employed in the cutting apparatus of the present invention. The circular knife support ring 20 has a main body 21 which defines a plurality of cutter knife stations 22. The cutter knife stations allow the respective cutter knives, as will be described hereinafter, to be positioned in a predetermined annularly spaced relationship one relative to the others. This circular knife support ring further has an outside peripheral edge 23, and an opposite, inside peripheral edge 24 which defines an aperture 25 of given dimensions as seen in FIG. 2. The aperture 25 is just slightly larger than the outside diametral dimension of the fixed axle 11. The circular knife support ring 20 is operable to be drivingly rotated at a given operational speed about the fixed axle member 11 so as to position individual cutter knife stations 22 in substantial alignment, and in fluid receiving relation relative to the apertures. As seen in the side elevation view of the circular knife support ring 20, as illustrated in FIG. 3, the plurality of cutter knife stations 21 are divided into several segments (6) which are spaced at approximately 60 degree orientations about the peripheral edge 23 of the main body 21. Further detail regarding the construction, and rotation of the circular knife support ring can be found by reference to U.S. Pat. No. 4,520,702 which is incorporated by reference, herein.

Figure 7:
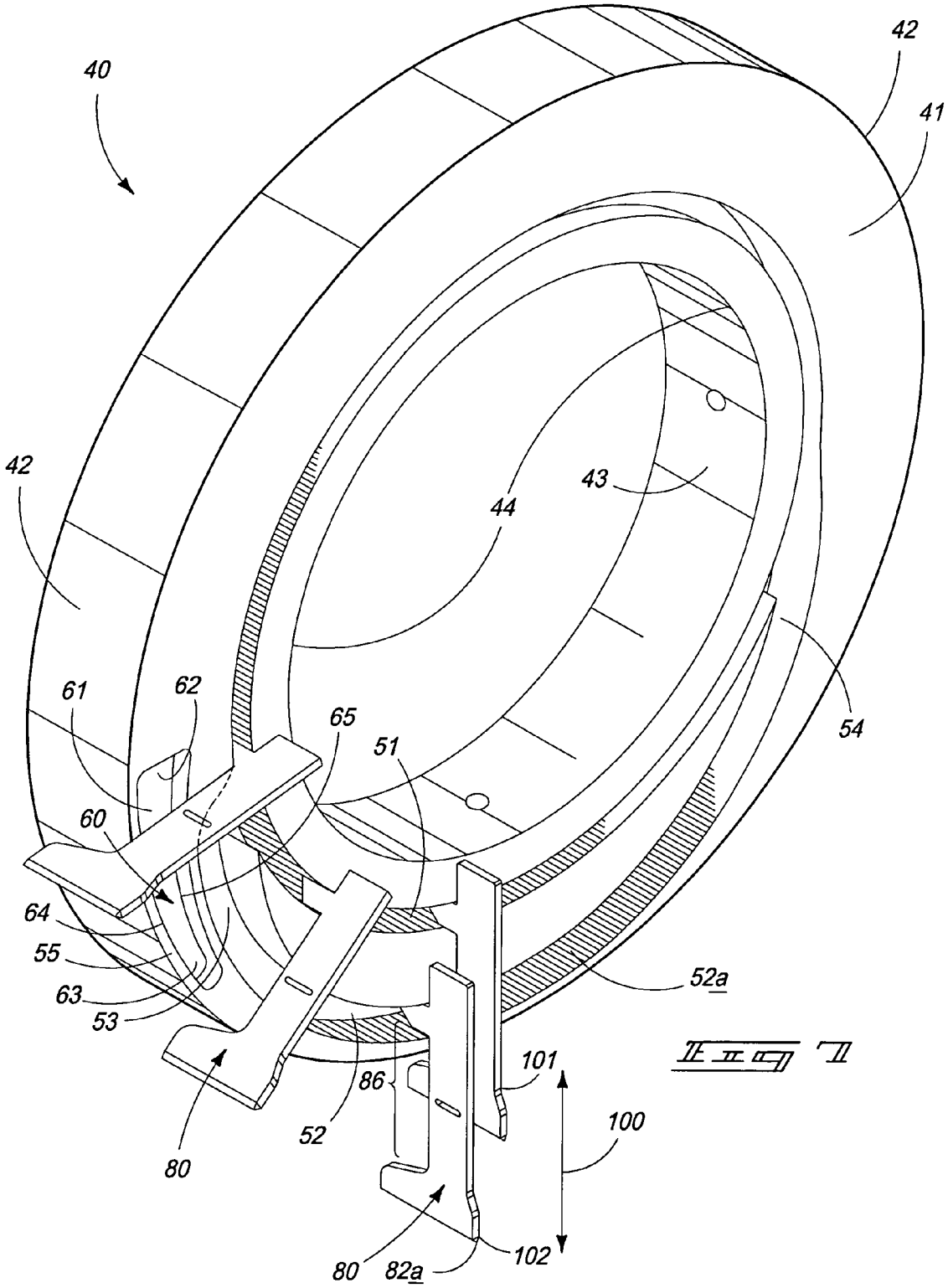
FIG. 7 is a top plan view of the annular track member employed in the cutting apparatus of the present invention.

Referring now to FIG. 1, and also to FIG. 7, it will be seen that the cutting apparatus 10 generally includes an annular track member 40 which is immovably mounted on the axle 11, and is juxtaposed relative to the circular knife support ring 20. The annular track member as seen in FIG. 7 has a main body 41 which is defined by an outside, substantially circular peripheral edge 42, and an opposite, inside peripheral edge 43 which defines an aperture 44 which has a diametral dimension which is just slightly greater than the outside diametral dimension of the fixed axle 11 upon which it is mounted. The annular track member 40 further defines a first substantially circular track or race 51 which is located in a predetermined, spaced relationship radially inwardly relative to the outside peripheral edge 42. The first substantially circular track 51 has substantially uniform dimensions of both width, and depth, and is operable to mechanically cooperate with a feature or portion of the respective cutter knives which will be discussed in the paragraphs which follow. As seen in FIG. 7, it should be understood that the annular track member 40 further defines a second track 52 which has a first end 53 which diverges from the first circular track 51, and further has a second or converging end 54 which rejoins the first circular track 51 at a predetermined location which is spaced from the first end 53. The second track 52 occupies a portion of the region of the annular track member located between the first substantially circular track 51, and the peripheral edge 42. The second track 52 has a portion 52A that is located closely near the peripheral edge 42 thereof. This is clearly illustrated in FIG. 7. As seen by reference to FIG. 7, there is a region 55 of the annular track member 40, and which is located adjacent to the first or diverging end 53 of the second track 52 and this is where a magnet 60 is mounted. The magnet 60 will be discussed in greater detail in the paragraphs which follow. It should be noted from a study of FIG. 7, that the second track 52 does not have a substantially uniform width dimension, but rather the first or diverging end 53 has a width dimension which is greater than the second or converging end 54 thereof.

It will be appreciated by a study of FIG. 7 that the respective cutting knives 80, as will be discussed in the paragraphs which follow, are designed to matingly cooperate, and travel along the annular track member 40, and more specifically, the first and second tracks thereof 51 and 52 and by doing so, the annular track member 40 defines, at least in part, a reciprocal course of movement for the respective cutter knives 80.

Figure 6:
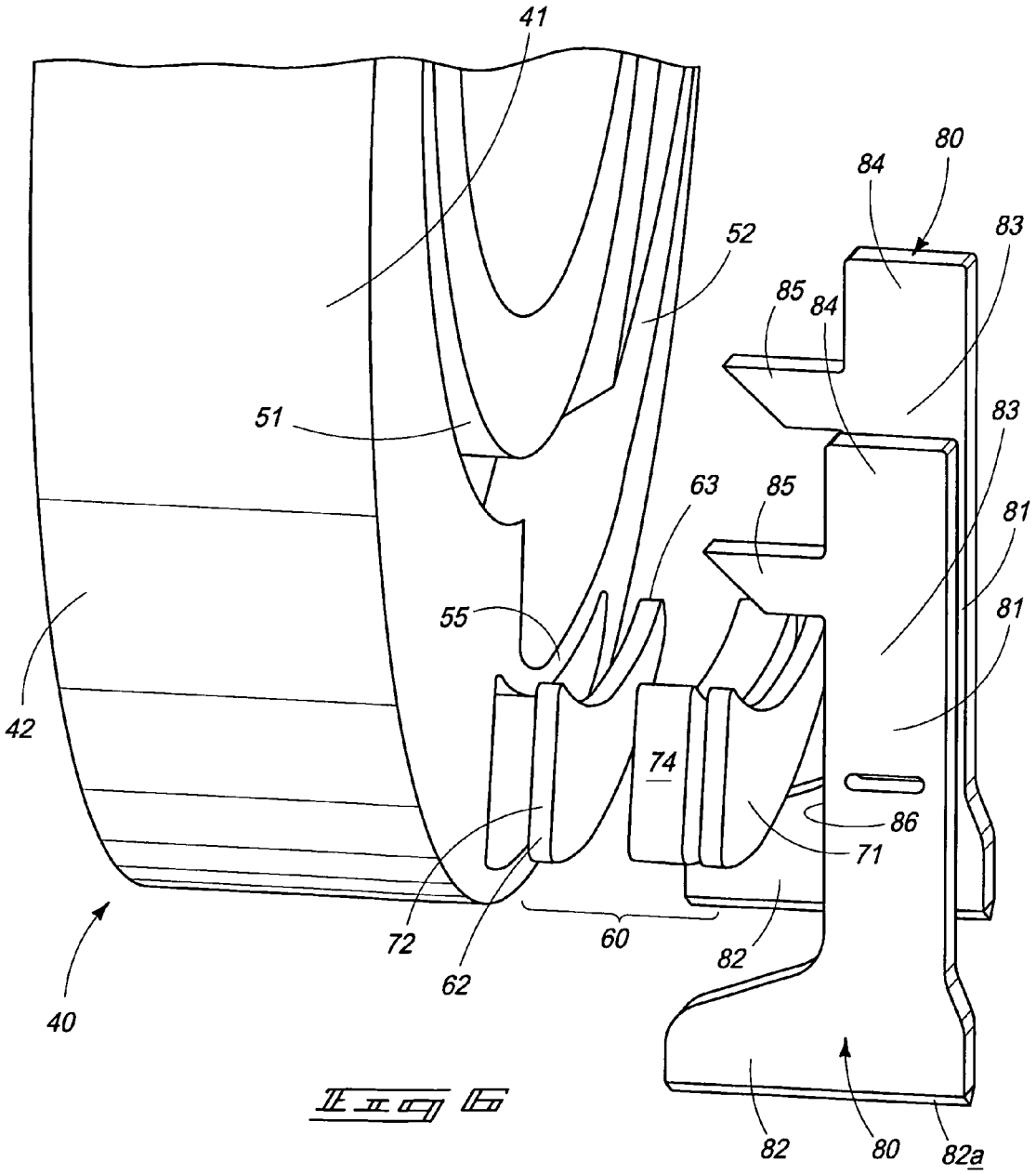
FIG. 6 is a fragmentary, exploded, side-elevational view of the magnet located on the annular track member, and several cutting knives as employed in the cutting apparatus of the present invention.
Figure 8:
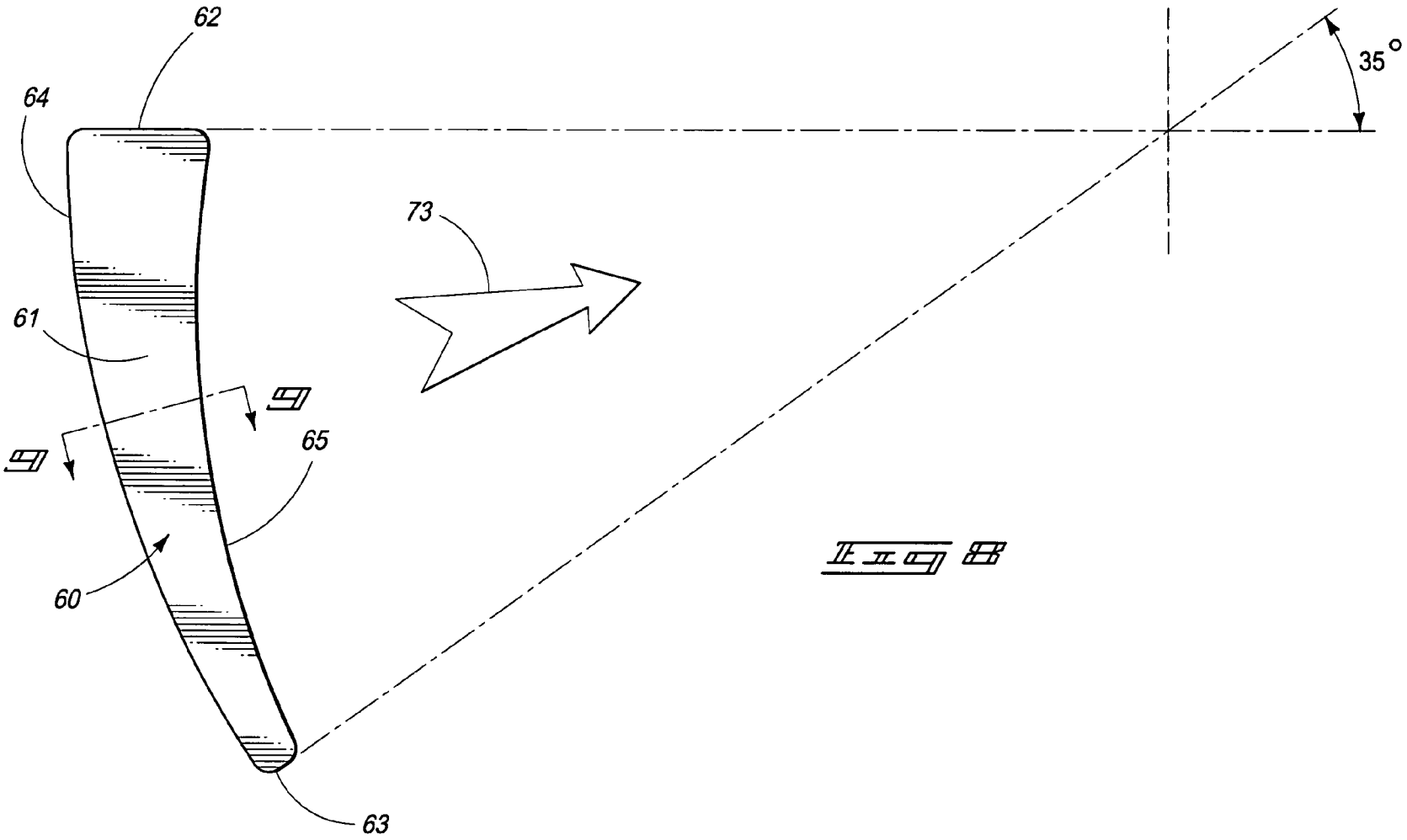
FIG. 8 is a top plan view of the magnet which is mounted on the annular track member, and which is employed in the cutting apparatus of the present invention.
Figure 9:
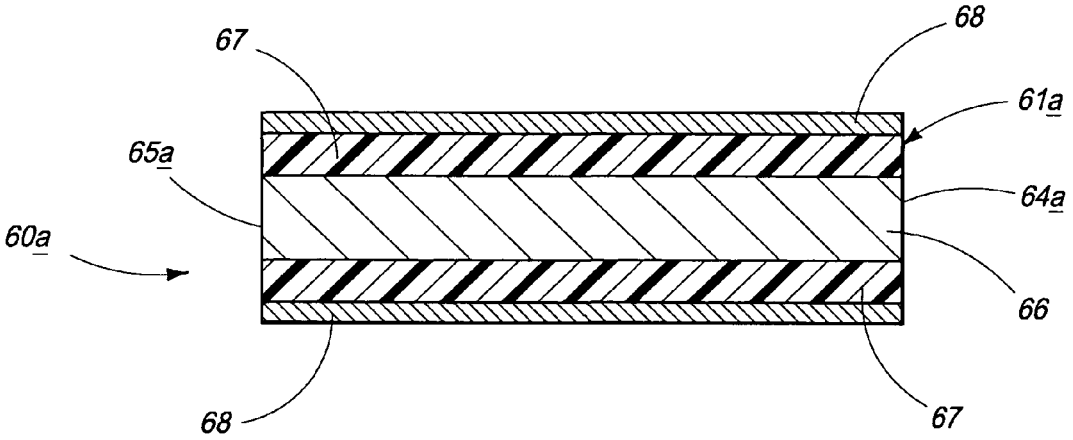
FIG. 9 is a transverse vertical sectional view of a second form of a magnet which finds usefulness in the present invention, and which is taken from a position along line 9-9 of FIG. 8.

Referring now to FIGS. 6, 7 and 9, it will be seen that the cutting apparatus 10 of the present invention includes a magnet which is generally indicated by the numeral 60, and which is mounted in the region 55 of the annular track member 40, and which is effective in magnetically attracting, and partially restraining the respective cutter knives 60, as will be discussed hereinafter, when the respective cutter knives are located at the opposite ends of a reciprocal path of travel which will be described hereinafter. The first form of the magnet is designated by the numeral 60. A second form of the magnet is designated by numeral 60A in FIG. 9. The structural difference in these two forms of the magnet will be discussed below. However, it should be understood that each form of the magnet operates in substantially the same way to effect the novel features of the present invention. More specifically, and as will be discussed in more detail, hereinafter, the magnet 60 is mounted on the annular track member 40, and is operable to releasably, magnetically restrain a cutter knife 60, as will be described, hereinafter, when the cutter knife 60 is in either a first non-cutting position or a second cutting position. The magnet 60, as used in the present invention, has a curved main body 61, which has a first end 62, and a second end 63. As will be seen in the drawing, the main body 61 has a width dimension which diminishes when this width dimension is measured from the first end, in the direction of the second end 63. Still further, the main body 61 has an outside facing sidewall 64 which has a curvature which is substantially similar to the curvature as measured along the circumference, or peripheral edge 42 of the annular track member 40. As will be recognized by a study of FIG. 7, the inside facing sidewall 65 of the magnet 60 also defines a curved surface which has a curvature which may be similar, or different, from that of the outside facing surface 64. As will be seen from a study of FIG. 7, the magnet 60 is located in the region 55 which is positioned between the first or diverging end of the second track 52, and the outside peripheral edge 42 of the annular track member 40. As seen in the drawings, the curvature of the inside facing sidewall 65 of the magnet is substantially similar to the curvature of the first diverging end 53 of the second track 51 as defined by the annular track member 40. As will be seen by a study of FIG. 8, the magnet 60 exerts a magnetic force of greater than about 0.5 Newtons which is oriented in a direction that is generally radially inwardly oriented relative to the circular knife support ring 20. Additionally, it will be seen from the drawings that the magnet 60 comprises a main body 61 which has a first portion 71, and a second portion 72, which are spaced one from the other (FIG. 6). Again, the principal magnetic force 73 provided by the magnet 60 is oriented generally radially inwardly relative to the knife support ring 20. Still further, the first and second portions of the magnet 71 and 72 are spaced from each other by a spacer 74 which positions the first and second portions in predetermined spaced relationship. The spacer is typically fabricated from polycarbonate. It has a thickness dimension of about 3 mm. As should be understood by a study of FIG. 8, the first form of the magnet 60 has a curved main body 71. The magnet's overall shape is such that the magnetic force exerted by the magnet is variable when measured along the length dimension of the curved main body and generally, radially inwardly relative to the annular track member 40. The generated magnet force diminishes when measured from the first end 62, to the second end 63. As seen in FIG. 8, the magnet 60 is located near to, and inwardly relative to the outside peripheral edge 42 of the annular track member 40, and further occupies less than about 35 degrees of the circumference of the annular track 40. It being understood that the circumference of the annular track member 40 is measured along the outside peripheral edge 42 of the annular track member 40.

Referring now to FIG. 9, the second form of the magnet 60A is illustrated in a vertical, sectional view. It will be understood that like numbers indicate like structures in this figure. In this second form of the magnet 60A, the magnetic portion comprises a single magnet 66 mounted centrally of the unitary structure. Further, the magnetic portion 66 is sandwiched between two plastic synthetic spacers each indicated by the numeral 67. Further, to complete the structure of the second form of the magnet 60A, the structure discussed above, is sandwiched between a pair of spaced, stainless steel magnetic shunts 68. Again, the second form of the magnet operates in substantially the same fashion as what has earlier been described.

Referring now to FIG. 1, and following, it will be seen that the cutting apparatus 10 of the present invention employs a plurality of cutter knives which are generally indicated by the numeral 80, and which are selectively reciprocally moveable along a given path of travel which will be discussed, below, from a first non-cutting position, to a second, radially extended cutting position relative to the circular knife support ring 20, and annular track member 40 within which the cutter knives mechanically cooperate. More specifically, the cutter knife 80 as seen in FIG. 6, and following, has a leg shape main body 81 which has a first, foot shaped end 82, and which has a blade like edge 82A, and a leg shaft 83 extends from the first foot shaped end 82 and terminates in a second end 84. Still further, a projection or cam follower 85 is made integral with the leg shaft 83, and extends normally outwardly relative thereto, and is disposed in the same plane as the first foot shaped end 82. The projection, or cam follower 85 is operable to be received in move along, and otherwise mechanically cooperate with either the first circular track 51, or second track 52, which is defined by the annular track member 40. The cam follower is located approximately mid-way between the first end 82, and the second end 83. The movement of one of the respective cutter knives 80 into these individual tracks (51, 52) defines, at least in part, a reciprocal course of travel for the individual cutter knives 80. As seen in the drawings, a gap 86 is defined between the first foot shaped end 82 and the projection 85. This gap defines the length of the course of travel of the respective cutter knives 80. The present cutter knife 80 is substantially similar in its overall shape to the cutter knife described in U.S. Pat. No. 4,520,702 which is incorporated by reference herein. Further, the respective cutter knives 80 are received, and slideably supported in the individual cutter knife stations 22 as defined by the circular knife support ring 20, and which further defines, in part, the course of travel of same. Therefore, the cutter knives 80 move along a course of travel which is substantially similarly to that earlier described in the aforementioned US Patent. More specifically, and by means of the selective application of the source of fluid pressure 13 to the second ends 84, of the respective cutter knives 80, the individual cutter knives 80 are moved radially outwardly relative to the circular knife support ring 20 such that the projections or cam follower 85, which typically travels along the first substantially circular track 51, moves outwardly, and in the direction of the second circular track 52 in the area where the second track 52 diverges from the first track 51. As the projection or cam follower 85 moves into the second track 52, the projection 85 is magnetically attracted toward the magnet 60 therefore ensuring that the cutter knife 80, which is being rotatably carried by the circular knife support ring 20 continues to be guided along the second track 52 and is reliably moved radially outwardly to an extended cutting position by the continued rotation of the circular knife support ring 20 relative to the fixed annular track member 40. The extended cutting position will be discussed, below. Upon the continued rotation of the circular knife support ring 20, the cutter knife 80 which has been placed or moved into the second track 52 by the radially outward movement of the cutter knife 80 under the influence of the exerted fluid pressure 13, and the rotation of the knife support ring 20 relative to the fixed annular track member 40, eventually converges with the first track 51, and is then effectively withdrawn from the extended cutting position, and is moved radially inwardly relative to the circular knife support ring 20, to a withdrawn, non-cutting position, as will also be discussed below. In the withdrawn, or non-cutting position, the magnet 60 is also effective in magnetically restraining the main body 81 of the cutter knife 80 by magnetically attracting the first foot shaped end 82 so as to prevent premature movement of the cutter knife 80 radially outwardly, and into a cutting position. As earlier discussed, this premature movement of the cutter knives is caused, at least in part, by the centrifugal force experienced by the respective cutter knives 80 by the rotation of the circular knife support ring 20. As should be understood, the magnetic force exerted on the first foot shaped end 83 is easily overcome by the force exerted by the source of fluid pressure 13 applied to the second end 84 thereof.

Figure 6A:
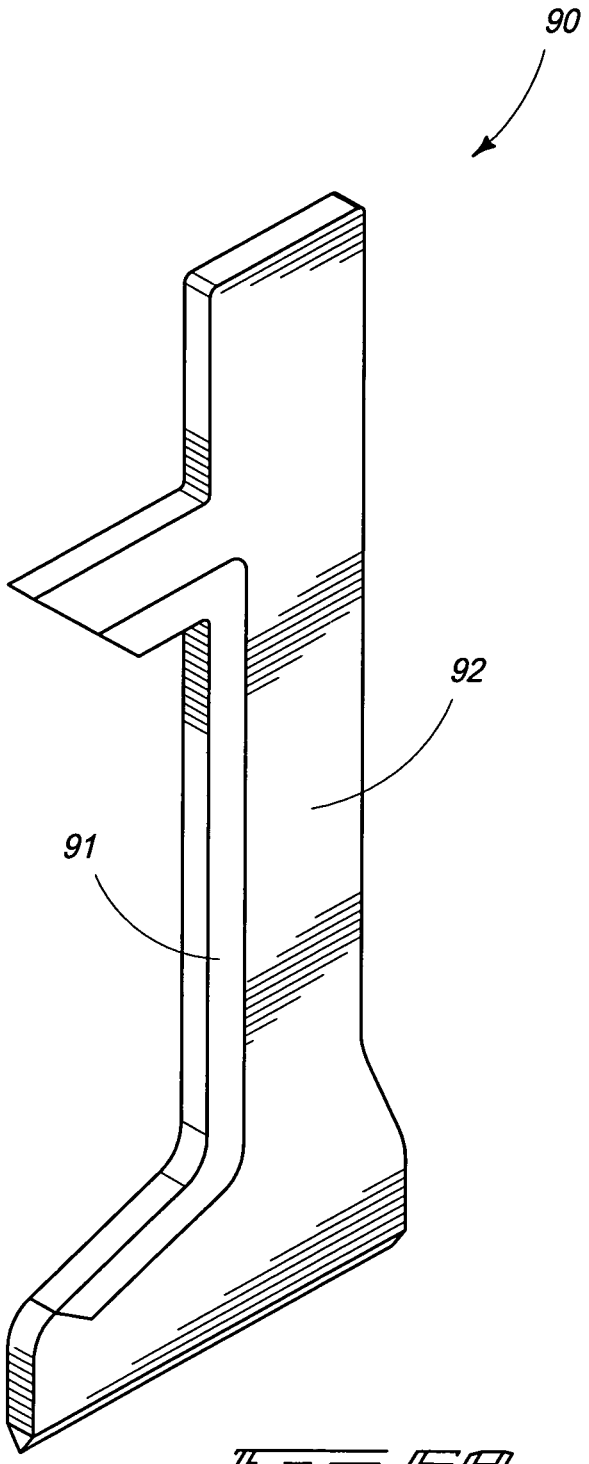
FIG. 6A is a side elevational view of an alternative form of the cutting knife employed with the present invention.

As seen in FIG. 6A, a second form of the cutting blade 90 is shown. In this form of the invention, the cutter blade 90 is fabricated from a material, only a portion of which 91 is metallic, and which can be magnetically attracted, and interact with the magnet 60 as described above. Still further, in this second form of the invention, the cutting blade 90 may have a non-metallic portion 92 which is not magnetically attracted to the magnet, and which would still be effective in cutting various elongated food or other products, as earlier disclosed. However, and more typically, the individual cutter knives 80 will be fabricated from a uniform metal substrate which is magnetically attracted by the magnet and can be restrained both in the non-operational or non-cutting position, and the second cutting position as will be discussed below. The preferred form of the cutting knives are typically fabricated from 410 stainless steel, and have a typical length dimension of about 66 mm. and a thickness dimension of about 1.5 mm. In the present invention, the cutter knives 80, as indicated above, are movable along a reciprocal path of travel 100 between a first, withdrawn or non-cutting position 101; and a second, extended or cutting position 102, as seen in the drawings. As earlier noted, the magnet 60 or 60A which is mounted on the annular track member 40 is effective in magnetically attracting and partially restraining the cutter knife when the cutter knife is located at the opposite ends of the reciprocal path of travel 100. Still further, when the cutter knife 80 is in the first non-cutting position 101, the magnet 60 or 60A is effective in restraining radially outward movement which might be caused or occasioned by the centrifugal force experienced by the cutter knives 80 by the rotation of the circular knife support ring. On the other hand, when the source of fluid pressure 13 is selectively supplied to the second end 84, it is sufficient to overcome the magnetic force acting on the first foot shaped end 83, and moves the respective cutter knives 80 to the second, extended cutting position 102. The magnet 60 or 60A is effective in magnetically drawing, or acting upon the projection or cam follower 85 so that the cutter knives 80 proceed to, and are diverted into, the second track 52 as defined by the annular track member 40, and therefore are reliably moved radially outwardly into an appropriate extended second cutting position 102 as seen in the drawings by the controlled rotation of the knife supporting ring 20, and the interaction or cooperation of the projection or cam follower 85 with the second track 52. As should be understood, and when no fluid pressure 13 is applied to the second end 84 of a cutter knife 80, the projection or cam follower 85 remains in the first track 51 as the knife support ring 20 rotates relative to the fixed annular track member 40. This maintains the cutter knife 80 in the first non-cutting position 101.

Operation

The operation of the described embodiment of the present invention is believed to be readily apparent and is briefly summarized at this point.

In its broadest aspects, the present invention includes a cutting apparatus 10 having a cutter knife 80 which is reciprocally moveable from a first non-cutting position 101, to a second cutting position 102. A track member 40 is mounted adjacent to the cutter knife 80, and which mechanically cooperates with the cutter knife so as to define, at least in part, the first non-cutting position 101, and the second cutting position 102 of the cutter knife 80; and a magnet 60 is mounted on the track member 40 and which releasably magnetically restrains the cutter knife 80 when the cutter knife is in the first non-cutting position 101, and the second cutting position 102.

More specifically, the cutting apparatus 10 of the present invention includes a cutter knife 80 which is supported for reciprocal movement along a path of travel 100 which has opposite ends 101 and 102. A source of fluid pressure 13 is provided, and which is selectively delivered to the cutter knife 80 to move the cutter knife in a given direction along the path of travel 100 from one end 101 to the other 102. A track member 40 is provided and positioned adjacent to, and mechanically cooperates with, the cutter knife 80, and which is effective in defining the reciprocal movement of the cutter knife along the path of travel 100. Finally, a magnet 60 is mounted on the track member 40, and which is effective in magnetically attracting and partially restraining the cutter knife 80 when the cutter knife is located at the opposite ends of the reciprocal path of travel 100.

In particular, the present invention relates to a cutting apparatus 10 which includes an axle 11, and wherein a circular knife support ring 20 is provided, and which is supported for rotation about the axle. The knife support ring 20 has an outside peripheral edge 23, and further, when rotated, experiences centrifugal force. A plurality of cutter knives 80 are supported by the knife support ring 20, and are further individually, radially, reciprocally moveable relative thereto. In the present invention, a source of fluid pressure 13 is provided, and which is selectively delivered to the respective cutter knives 80 for propelling the individual cutter knives 80 along a path of travel 100 which is radially, outwardly oriented relative to the knife support ring 20. An annular track member 40 is fixedly mounted on the axle, and located adjacent to the rotatable knife support ring. The annular track member 40 has an outside peripheral edge 42, and further defines a plurality of tracks 51 and 52, which individually, mechanically cooperate with a portion of the plurality of cutter knives 80 so as to cause the respective cutter knives to move radially inwardly, and outwardly, relative to the peripheral edge 42 of the knife support ring 40, and along the path of travel 100, when the source of fluid pressure 13 propels individual cutter knives radially outwardly relative to the knife support ring 40. Finally, the present invention includes a magnet 60 or 60A which is mounted adjacent to the peripheral edge 42 of the of the annular track member 40, and which has a magnetic force which is effective so as to magnetically restrain the movement of the plurality of cutter knives 80 in a radially outward direction relative to the knife support ring 20, and against the centrifugal force experienced by the knife support ring 20, and the respective cutter knives 80, when the knife support ring 20 is rotated. Further, the magnetic force acting on the respective cutter knives 80 is overcome when the source of fluid pressure 13 is applied to the respective cutter knives 80 so as to move the respective cutter knives along the path of travel 100, and radially outwardly relative to the knife support ring 20. In the arrangement as seen in the drawings, the annular track 40 defines a first radially, inwardly oriented track 51 which is located in spaced relation relative to the peripheral edge 42 of the annular track 40, and a second radially outwardly disposed track 52 which is located adjacent to the peripheral edge 42. The second track 52 diverges from, and then converges with, the first track 51. The magnet 60 or 60A is located near the peripheral edge 42 of the annular track 40, and adjacent to the location 53 where the second track 52 diverges from the first track 51. A source of fluid pressure 13 which is selectively applied to the respective cutter knives 80 causes at least one of the cutter knives 80 to move out of or diverge from the first track 51, and move into the second track 52 and be magnetically acted upon by the magnet 60 or 60A so as to maintain the cutter knife 80 in a radially, outwardly, extended position 102 relative to the annular track member 40 as seen in the drawings, and travel along the second track 52. As should be understood, the magnet 60 or 60A has a variable magnetic force which extends generally radially inwardly relative to the annular track member 40. The magnetic force exerted by the magnet 60 or 60A on the cutter knife 80 diminishes as the cutter knife 80 increasingly diverges from the first track 51, and moves along the second track 52 to a position where it may then converge back with the first track 51. As earlier noted, the magnet 60 or 60A is effective to, at least in part, magnetically hold the respective individual cutter knifes 80 in a given orientation so that the cutter knives 80 may only travel along the first track 51 when no source of fluid pressure 13 is applied to the individual cutter knifes 80. Further, the magnet 60 or 60A is effective to, at least in part, magnetically attract, and move, at least in part, the individual cutter knives 80 into the second track 52 when the source of fluid pressure 13 is applied to the individual cutter knives 80 so as to move the individual cutter knives radially outwardly relative to the knife support ring 20, and the annular track member 40. The respective cutter knives 80 which move into and along the second track 52, are then delivered back to the first track 51 when the second track converges with the first track when received back into the first track, the respective cutter knives 80 are then located in the withdrawn non-cutting position 101.

Therefore, it will be seen that the cutting apparatus of the present invention provides a convenient means whereby the perceived shortcomings in the performance of the prior art device as seen in U.S. Pat. No. 4,520,702 are effectively overcome, and thereby provides a cutting assembly having increased robustness and reliability over that which has been known heretofore.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A cutting apparatus, comprising:

a cutter knife which is reciprocally moveable from a first non-cutting position, to a second, cutting position;

a track member mounted adjacent to the cutter knife, and which mechanically cooperates with the cutter knife so as to define, at least in part, the first non-cutting position, and the second, cutting position of the cutter knife; and a magnet mounted on the track member and which releasably magnetically restrains the cutter knife when the cutter knife is in the first non-cutting position, and the second, cutting position, and wherein the magnet has a main body with opposite ends, and which further has both a diminishing width dimension, and a diminishing magnetic force when measured in a given direction along the main body, and between the opposite ends thereof.

2. A cutting apparatus as claimed in claim 1, and wherein the cutter knife comprises a plurality of cutter knives which are oriented in an annularly oriented and spaced relationship, one to the others.

3. A cutting apparatus as claimed in claim 2, and further comprising a circular knife support ring positioned in juxtaposed relation relative to the track member and which supports the plurality of cutter knives in the annularly oriented and spaced relationship, one relative to the others, and wherein the circular knife support ring rotates, and creates centrifugal force which acts on the plurality of cutter knives, and wherein the magnet is effective, at least in part, to restrain the movement of the respective cutter knives against the effects of the centrifugal force exerted on the respective cutter knives when the respective cutter knives are in the first non-cutting position, and further magnetically draws, and then partially magnetically restrains the respective cutter knives in a given orientation relative to the track member so as to effectively move the respective cutter blades into the second, cutting position by the mechanical cooperation of the track member with the respective cutting knives.

4. A cutting apparatus as claimed in claim 1, and wherein the track member has a peripheral edge, and the magnet is located near the peripheral edge, and wherein the magnetic force exerted by the magnet is substantially perpendicular to the peripheral edge of the track member.

5. A cutting apparatus, comprising:

a cutter knife supported for reciprocal movement along a path of travel which has opposite ends;

a source of fluid pressure selectively delivered to the cutter knife to move the cutter knife in a given direction along the path of travel from one end to the other;

a track member positioned adjacent to, and mechanically cooperating with the cutter knife, and which is effective in defining, at least in part, the reciprocal movement of the cutter knife along the path of travel; and a magnet mounted on the track member, and which is effective in magnetically attracting and partially restraining the cutter knife when the cutter knife is located at the opposite ends of the reciprocal path of travel.

6. A cutting apparatus as claimed in claim 5, and further comprising:

an axle; and a knife support ring supported for rotation on the axle, and wherein the cutter knife is supported for reciprocal movement along the path of travel by the knife support ring, and wherein the track member is fixedly mounted on the axle, and juxtaposed relative to the knife support ring.

7. A cutting apparatus as claimed in claim 5, and wherein the track member has a peripheral edge, and the magnet is located near the peripheral edge, and wherein the magnetic force exerted by the magnet is substantially perpendicular to the peripheral edge of the track member.

8. A cutting apparatus as claimed in claim 5, and wherein the magnet has a main body with opposite ends, and which further has both a diminishing width dimension, and a diminishing magnetic force when measured in a given direction along the main body, and between the opposite ends thereof.

9. A cutting apparatus as claimed in claim 5, and wherein the track member has a peripheral edge, and further defines a first track which is located in spaced relation relative to the peripheral edge, and a second track, which diverges from the first track, and which is located adjacent to the peripheral edge of the track member, and wherein the magnet is located adjacent to where the second track diverges from the first track.

10. A cutting apparatus as claimed in claim 5, and wherein the cutter knife is formed, at least in part, of a metal which is magnetically attracted by the magnet.

11. A cutting apparatus as claimed in claim 5, and wherein the cutter knife has a leg shaped main body with a first, foot shaped end, and an opposite, second end, and wherein a blade is defined by the first, foot shaped end, and a leg shaft extends between the first foot shaped end, and the second end thereof, and wherein the source of fluid pressure is applied to the second end of the cutter knife, and wherein a projection extends normally outwardly relative to the leg shaft, and is located between the first and second ends of the leg shaped main body, and wherein the magnet magnetically attracts, and mechanically cooperates, alternatively, with both the first, foot shaped end, and the projection, so as to define the opposite ends of the path of travel of the cutter knife.

12. A cutting apparatus as claimed in claim 5, and wherein the magnet has a curved main body with a length dimension, and wherein the track member is annularly shaped, and has a circumference when measured along the peripheral edge thereof, and wherein the magnet is located along, and occupies less than about 35 degrees of the circumference of the annular shaped track member.

13. A cutting apparatus as claimed in claim 5, and wherein path of travel of the reciprocally moveable cutter knife is from a first, withdrawn, non-cutting position, to a second, extended cutting position.

14. A cutting apparatus, comprising:

an axle;

a circular knife support ring supported for rotation about the axle, and wherein the knife support ring has a peripheral edge, and further experiences centrifugal force when rotated;

a plurality of cutter knives moveably supported by the knife support ring, and which are individually, radially, reciprocally moveable relative thereto;

a source of fluid pressure selectively delivered to the respective cutter knives for selectively propelling the individual cutter knives, at least in part, along a path of travel which is radially, outwardly oriented relative to the knife support ring;

an annular track member mounted on the axle, and located adjacent to the knife support ring, and wherein the annular track member has an outside peripheral edge, and further defines a plurality of tracks which mechanically cooperate with the plurality of cutter knives so as to cause the respective cutter knives to move, at least in part, radially inwardly, and outwardly, relative to the peripheral edge of the knife support ring, and along the path of travel, when the source of fluid pressure propels individual cutter knives radially outwardly relative to the knife support ring, and the circular knife support ring rotates; and a magnet mounted adjacent to the peripheral edge of the of the annular track member, and which has a magnetic centripetal force which is effective so as to magnetically restrain the movement of the plurality of cutter knives in a radially outward direction relative to the knife support ring, and against the force experienced by the knife support ring, and the respective cutter knives, when the knife support ring is rotated, and wherein the magnetic centripetal force acting on the respective cutter knives is overcome when the source of fluid pressure is applied to the respective cutter knives so as to move the respective cutter knives along the path of travel, and radially outwardly relative to the knife support ring.

15. A cutting apparatus as claimed in claim 14, and wherein the magnet is effective in magnetically releasably securing the respective cutter knives in a radially outwardly extended position relative to the peripheral edge of the knife support ring when the source of fluid pressure is applied, and propels selective cutter knives radially outwardly relative to the knife support ring.

16. A cutting apparatus as claimed in claim 14, and wherein the magnet exerts a magnetic force which is oriented generally radially inwardly relative to the knife support ring.

17. A cutting apparatus as claimed in claim 14, and wherein the magnet has a main body which has a first and second portion which are spaced, one, from the other.

18. A cutting apparatus as claimed in claim 14, and wherein the magnet has a main body with opposite first and second ends, and a width dimension which diminishes when measured in a direction extending between the first and second ends.

19. A cutting apparatus as claimed in claim 14, and wherein the magnet has a curved main body which further has an outside facing sidewall which has a curvature substantially similar to the peripheral edge of the knife support ring, and an side facing sidewall which has a curvature different from that of the outside facing sidewall.

20. A cutting apparatus as claimed in claim 14, and wherein the magnet has a curved main body with a length dimension, and wherein the magnetic force exerted by the magnet is variable when measured along the length dimension of the curved main body, and radially inwardly relative to the annular track member.

21. A cutting apparatus as claimed in claim 14, and wherein the magnet has a curved main body with a length dimension, and wherein the annular track member has a circumference when measured along the peripheral edge thereof, and wherein the magnet is located near, and inwardly relative to the peripheral edge of the annular track member, and further occupies less than about 35 degrees of the circumference of the annular track.

22. A cutting apparatus as claimed in claim 14, and wherein the cutter knives are fabricated entirely from a metal which is magnetically attracted to the magnet.

23. A cutting apparatus as claimed in claim 14, and wherein the cutter knives are fabricated, at least in part, of a metal which is magnetically attracted to the magnet.

24. A cutting apparatus as claimed in claim 14, and wherein the respective cutter knives have a leg shaped main body with a first, foot shaped end, and an opposite, second end, and wherein a blade is defined by the first, foot shaped end, and a leg shaft extends between the first foot shaped end, and second end thereof, and wherein the source of fluid pressure is applied to the second end of the cutter knife, and wherein a projection extends normally outwardly relative to the leg shaft, and is located between the first and second ends of the leg shaped main body, and wherein the magnet is effective in magnetically attracting and cooperating with the first, foot shaped end, and the projection.

25. A cutting apparatus as claimed in claim 14, and wherein the annular track defines a first, radially inwardly oriented track which is located in spaced relation relative to the peripheral edge of the annular track, and a second, radially outwardly disposed track which is located adjacent to the peripheral edge, and wherein the second track diverges from, and then converges with, the first track, and wherein the magnet is located near the peripheral edge of the annular track and adjacent to the location where the second track diverges from the first track, and wherein the source of fluid pressure which is selectively applied to the respective cutter knives causes at least one of the cutter knifes to diverge from the first track, and move into the second track and be magnetically acted upon by the magnet so as to maintain the cutter knife in a radially outwardly extended position relative to the annular track member.

26. A cutting apparatus as claimed in claim 25, and wherein the magnet has a variable magnetic force which extends generally radially inwardly relative to the annular track member, and wherein the magnetic force exerted by the magnet on the cutter knife diminishes as the cutter knife increasingly diverges from the first track, and moves along the second track.

27. A cutting apparatus as claimed in claim 25, and wherein the magnet is effective to, at least in part, magnetically hold the respective individual cutter knifes in a given orientation so that the cutter knives may individually travel along the first track when no source of fluid pressure is applied to the individual cutter knifes, and further the magnet is effective to, at least in part, magnetically attract, and move, at least in part, the individual cutter knives into the second track when the source of fluid pressure is applied to the individual cutter knives, and wherein the continued rotation of the circular knife support ring and the mechanical cooperation of the plurality of cutter knives with annular track members, moves the individual cutter knives radially outwardly relative to the annular track member, and wherein the respective cutter knives which move into and along the second track, are then delivered back to the first track when the second track converges with the first track.

* * * * *